US007804050B2

(12) United States Patent
Kang et al.

(10) Patent No.: US 7,804,050 B2
(45) **Date of Patent: *Sep. 28, 2010**

(54) LINEARLY RECIPROCATING TRAY FOR MICROWAVE OVEN

(75) Inventors: Jeon Hong Kang, Yongin-Si (KR); Sang Jin Jeong, Yongin-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 12/106,592

(22) Filed: Apr. 21, 2008

(65) Prior Publication Data

US 2008/0190915 A1 Aug. 14, 2008

Related U.S. Application Data

(62) Division of application No. 11/285,091, filed on Nov. 23, 2005, now Pat. No. 7,361,873.

(30) Foreign Application Priority Data

Jul. 21, 2005 (KR) ..... 10-2005-0066300

(51) Int. Cl.
*H05B 6/78* (2006.01)

(52) U.S. Cl. ..... 219/754; 219/752; 219/762; 126/338

(58) Field of Classification Search ..... 219/752–755, 219/762, 763; 126/388
See application file for complete search history.

(56) References Cited

U.S. PATENT DOCUMENTS 5,593,609 A 1/1997 Fletcher
7,361,873 B2 * 4/2008 Kang et al. ..... 219/754
2002/0190062 A1 12/2002 Choi
2005/0016998 A1 * 1/2005 Choi ..... 219/754
2005/0274720 A1 * 12/2005 Jeong ..... 219/754

FOREIGN PATENT DOCUMENTS

JP 52-36347 3/1977
KR 10-451936 12/2002

OTHER PUBLICATIONS

U.S. Appl. No. 11/285,091, filed Nov. 23, 2005, Jeon Hong Kang, et al.

* cited by examiner

*Primary Examiner*—Quang T Van
(74) *Attorney, Agent, or Firm*—Staas & Halsey LLP

(57) ABSTRACT

A microwave oven in which a power transmission transmitting driving force of a motor moves a tray right and left without direct contact with the tray. The microwave oven includes a support disposed between a bottom plate and the tray to support the tray and the power transmission transmitting driving force of the motor to the support such that the support linearly travels. The shape of an oval guide hole formed in the support is changed to adjust the stopping time of the support at the rightmost or leftmost side. The tray linearly travels together with the support when the support linearly travels. The microwave oven further includes a tray restriction device or a tray moving device for guiding the linear movement of the tray. The tray restriction device and the tray moving device are implemented by locking steps, grooves, protrusions, or rollers.

6 Claims, 15 Drawing Sheets

LINEARLY RECIPROCATING TRAY FOR MICROWAVE OVEN

CROSS-REFERENCE TO RELATED APPLICATIONS

This application is a divisional of application Ser. No. 11/285,091 filed Nov. 23, 2005 now U.S. Pat. No. 7,361,873 and claims the benefit of Korean Patent Application No. 10-2005-0066300, filed on Jul. 21, 2005, in the Korean Intellectual Property Office, the disclosure of which is incorporated herein by reference.

BACKGROUND OF THE INVENTION

1. Field of the Invention

The present invention relates to a microwave oven, and more particularly, to a microwave oven including a linearly reciprocating tray, which enables food to be uniformly cooked.

2. Description of the Related Art

Microwave ovens are cooking devices using electronic waves. The microwave oven projects microwaves to food to be cooked to vibrate water molecules in the food, and cooks the food using frictional heat generated between water molecules as heat for cooking the food.

When the microwaves are projected and reflected from the inner walls of a cooking chamber, traveling microwaves and the reflected microwaves are superposed, and the electromagnetic field formed within the microwave ovens exhibits strong and weak spots. Due to the inconsistent distribution of the electromagnetic field, food cannot be heated uniformly, so that food is unevenly cooked. Thus, to avoid this phenomenon, food, i.e. an object to be heated, is moved or the traveling direction of the microwaves is changed such that the microwaves are uniformly projected to the food if possible.

Among the conventional methods, the method of using a rotary tray is widely known. However, the method of using a rotary tray has disadvantages in that, when long food is placed on the rotary tray, the long food contacts the rear wall of the cooking chamber or the inner surface of a door so that the long food cannot be smoothly rotated and cooked. Particularly, since a wall-mounted type microwave oven with a hood function has a relative longer side in the right-left direction, the rotary tray cannot effectively use cooking space of the microwave oven.

Thus, by taking this problem into consideration, a tray device linearly reciprocating in the lateral direction is utilized. The linearly reciprocating tray device is disclosed in Korean Patent Laid-Open No. 2002-96424. The disclosed conventional linearly reciprocating tray device includes a tray having a groove formed in the lower side thereof, and a rotation member having an eccentric protrusion inserted into the groove. In the conventional linearly reciprocating tray device, when the rotation member is rotated by a motor, the eccentric protrusion or a bearing fitted around the eccentric protrusion moves along the inner surface of the groove to move the tray in the right-left direction.

However, in the conventional linearly reciprocating tray device, since the eccentric protrusion or the bearing is inserted into or fitted around the groove while keeping a small gap, the tray hardly stays at the right and left sides of the cooking chamber and passes by the central area of the cooking chamber. Thus, food is chiefly cooked at the central area of the cooking chamber so that food cannot be uniformly cooked.

Moreover, in the conventional linearly reciprocating tray device, since the eccentric protrusion or the bearing directly contacts the tray which may be heated heated to a high temperature during the operation of the microwave oven, the eccentric protrusion or the bearing may be deformed due to the heat unless they are made of highly heat-resistant materials.

Additionally, according to the conventional linearly reciprocating tray device, the eccentric protrusion or the bearing must be inserted into or fitted around the groove formed in the lower side of the tray. However, since the tray, made of glass, is heavy, a user feels difficulty to clean the tray and to couple the protrusion with the groove.

SUMMARY OF THE INVENTION

The present invention has been made in view of the above-mentioned problems, and an aspect of the invention is to provide a microwave oven in which there is substantially no difference between time when a linearly traveling tray travels from the right side to the left side of a cooking chamber and time when the linearly traveling tray stays at the right side or the left side, so that food is uniformly cooked at the central area and the right and left sides of the cooking chamber.

It is another aspect of the present invention to provide a microwave oven for preventing a power transmission from directly contacting a hot tray, thereby manufacturing the power transmission without restriction of material and guaranteeing reliability of the microwave oven.

It is yet another aspect of the present invention to provide a microwave oven having a tray device for guaranteeing convenient installation of a tray device.

In accordance with one aspect, the present invention provides a microwave oven including a cooking chamber having a bottom plate, a tray linearly traveling in the cooking chamber, a motor for providing driving force to the tray, a support disposed between the bottom plate and the tray to support the tray, and a power transmission for transmitting the driving force of the motor to the support such that the support linearly travels.

The support may have a guide hole formed in the central area of the support to guide the linear movement of the support, and the power transmission rotates and travels in the guide hole and contacts the inner surface of the guide hole such that the support linearly travels in the right-left direction.

The guide hole has an oval shape, and the power transmission contacts the guide hole in a region to move the support in the right-left direction, and freely moves in the outside of the region. As such, when the power transmission travels freely, the support and the tray supported by the support stop.

At that time, the power transmission contacts the guide hole to move the support to the rightmost side or to the leftmost side while rotating by 90 degrees, and freely moves while rotating by 90 degrees again.

The power transmission may include a linkage including an end coupled with a rotation shaft of the motor and the other end contacting the inner surface of the guide hole. The linkage may include a roller installed at an end contacting the inner surface of the guide hole.

The power transmission may include a linkage having an end coupled with a rotation shaft of the motor and a protrusion protruded upward from the linkage, and the protrusion contacts the inner surface of the guide hole to transmit the driving force to the support. The protrusion may have a roller adopting the protrusion as a rotation shaft.

In accordance with another aspect of the present invention, the present invention provides a microwave oven including a cooking chamber having a bottom plate, a tray linearly traveling in the cooking chamber, a motor for providing driving force necessary for the movement of the tray, a support disposed between the bottom plate and the tray to support the tray, a power transmission for transmitting the driving force of the motor to the support such that the support linearly moves, and a tray restriction device for maintaining the same movement of the tray as the movement of the support.

The tray restriction device may include a locking step protruded from the lower surface of the tray, and the locking step surrounds the outer circumference of the support when the tray is placed on the support.

The tray restriction device may be structured by grooves and protrusions formed between the lower surface of the tray and the upper surface of the support.

Moreover, the support may include a guide roller installed at a surface of the cooking chamber adjacent to the bottom plate of the cooking chamber such that the support smoothly travels on the bottom plate.

In accordance with another aspect of the present invention, the present invention provides a microwave oven including a cooking chamber having a bottom plate, a tray linearly traveling in the cooking chamber, a motor for providing driving force necessary for the movement of the tray, a support disposed between the bottom plate and the tray to support the tray, a power transmission for transmitting the driving force of the motor to the support such that the support linearly moves, and a tray moving device for moving the tray when the support travels.

The tray moving device may include a movable roller installed in the support to contact the bottom plate disposed below the movable roller and to contact the lower surface of the tray disposed above the movable roller. A guide groove or a guide rail for guiding the movable roller may be formed in the lower surface of the tray or in the bottom plate.

Moreover, the tray may further include locking steps protruded from the right end and the left end of the lower surface of the tray to restrict the linear movement of the tray.

Additional aspects and/or advantages of the invention will be set forth in part in the description which follows and, in part, will be apparent from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF THE PREFERRED EMBODIMENTS

Figure 1:
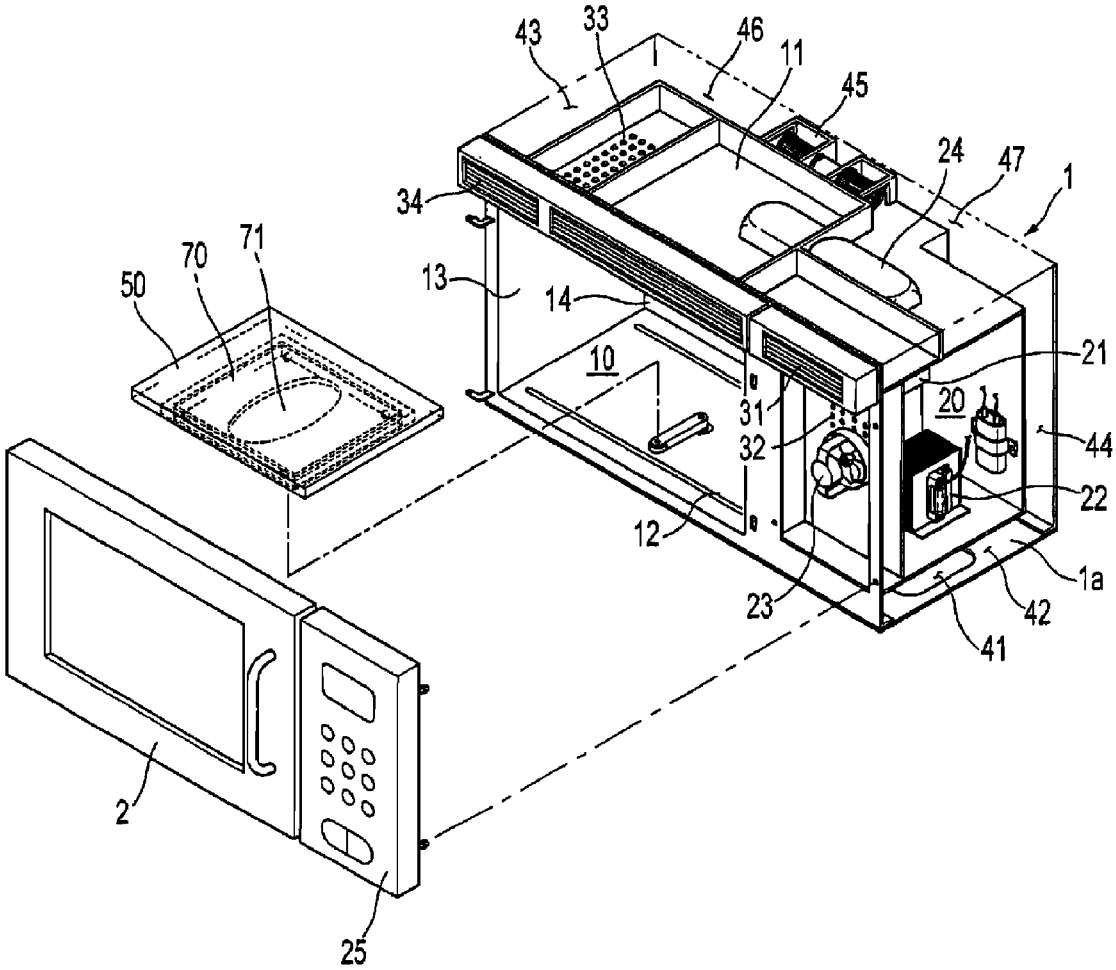
FIG. 1 is a perspective view illustrating the structure of a microwave oven according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Hereinafter, a wall-mount type microwave oven will be described as an example. However, the present invention can be applied to a general microwave oven. FIG. 1 is a perspective view illustrating the structure of a microwave oven according to an embodiment of the present invention.

As shown in FIG. 1, the microwave oven according to the preferred embodiment of the present invention is structured such that a cooking chamber 10 for cooking food, placed in a main body 1 forming the external appearance of the microwave oven, and an electric device room 20, in which various electric devices are installed, are distinguished.

The cooking chamber 10 is a cooking space defined by an upper plate 11, a bottom plate 12, side plates 13, and a rear plate 14 and has an opened front side. At a side of the main body 1, a door 2 for opening and closing the opened front side of the cooking chamber 10 is hinged.

A magnetron 21 for supplying high frequency waves to the inside of the cooking chamber 10, a high voltage transformer 22 for applying high voltage to the magnetron 21, and a cooling fan 23 for cooling the inside of the electric device room 20, are installed in the electric device room 20. Moreover, at the upper sides of the electric device room 20 and the cooking chamber 10, a wave-guide 24 is installed to guide the high frequency waves supplied from the magnetron 21 to the cooking chamber 10, and at the front side of the electric device room 20, a control panel 25, in which a plurality of operation buttons for controlling various operation of the microwave oven and display for displaying operation state of the microwave oven are installed, is installed.

Moreover, the microwave oven according to an embodiment of the present invention includes a ventilation passage for cooling the electric device room 20 and ventilating the cooking chamber 10, and a discharging passage for discharging gas or smoke generated in a gas oven (not shown) disposed at the lower side of the main body 1. Meanwhile, at the upper rear side of the main body 1, a discharging fan 45 is installed to discharge gas or smoke guided through the discharging passage to the outside of the microwave oven.

The ventilation passage includes a front suction port 31, formed at the upper side of the control panel 25 and communicated with the inside of the electric device room 20 to allow exterior air to enter the electric device room 20, and a plurality of through-holes 32, formed in the side plate 13 of the cooking chamber 10 such that the air supplied through the front suction port 31 cools the inside of the electric device room 20 and enters the cooking chamber 10. Additionally, the ventilation passage includes a plurality of through-holes 33 formed in the upper plate 11 of the cooking chamber 10 to discharge air in the cooking chamber 10 to the outside, and a front discharge port 34 formed at the front upper side of the cooking chamber 10.

Thus, when the cooling fan 23 is driven, air entering the electric device room 20 through the front suction port 31 cools the inside of the electric device room 20 and enters the cooking chamber 10 through the through-holes 32 of the side plate 13 to ventilate the cooking chamber 10 and is discharged to the exterior via through-holes 33 of the upper plate 11 and the front discharge port 34.

The discharging passage includes a suction port for discharge use 41 formed in the bottom plate 1*a* of the main body 1, a lower passage 42 defined by a space formed between the cooking chamber 10 and the electric device room 20 and the bottom plate 1*a* of the main body, two upward passage 43 and 44 respectively formed at the outer side of the side plate 13 of the cooking chamber 10 and at the rear side of the electric device room 20, and upper passages 46 and 47 formed at the upper side of the main body 1 to guide gas or smoke guided by the upward passages 43 and 44 to the discharging fan 45. Thus, when the discharging fan 45 is driven, gas or smoke is sucked through the suction port for discharge use 41 and sequentially passes through the lower passage 42, the two upward passages 43 and 44, and the upper passages 46 and 47 and is discharged to the exterior.

Meanwhile, the microwave oven according to an embodiment of the present invention includes a tray device linearly reciprocated within the cooking chamber 10 in the right-left direction and allowing food to be uniformly cooked. Particularly, the tray device employed in the microwave oven according to an embodiment of the present invention is structured such that a power transmission for transmitting driving force of a motor does not directly move the tray, but the power transmission moves a support for supporting the tray and the tray is reciprocated by the movement of the support.

Figure 2:
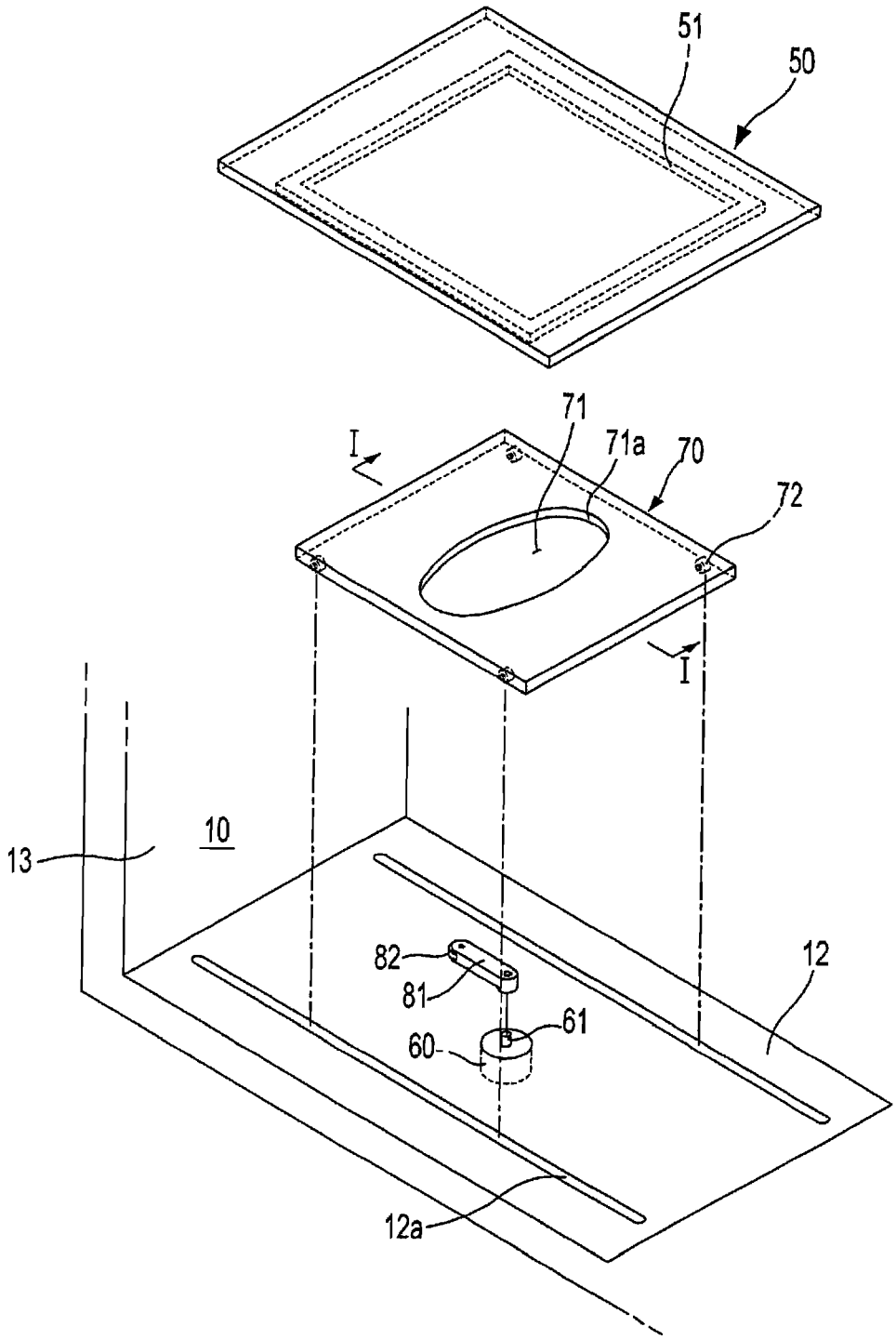
FIG. 2 is an exploded perspective view illustrating the structure of a tray device of a microwave oven according to a first embodiment of the present invention.
Figure 3:
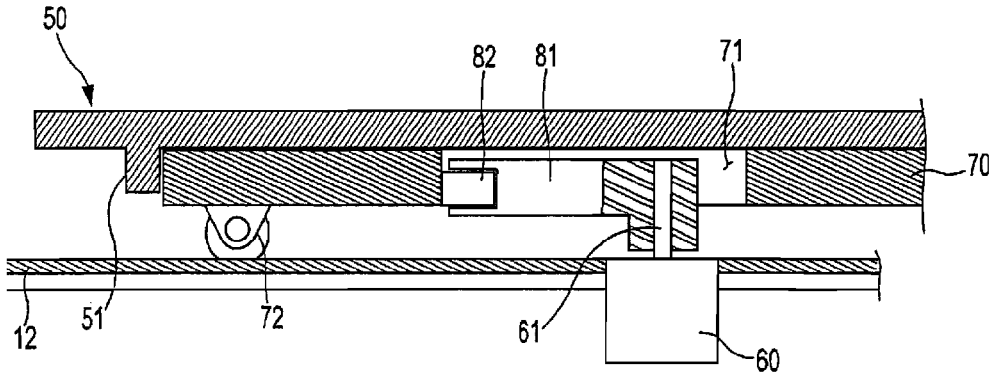
FIG. 3 is a sectional view taken along the line I-I in FIG. 2 when the tray device in FIG. 2 is assembled.

FIG. 2 is an exploded perspective view illustrating the structure of a tray device of a microwave oven according to a first embodiment of the present invention, and FIG. 3 is a side sectional view taken along the line I-I in FIG. 2 when the tray device in FIG. 2 is assembled.

As shown in FIGS. 2 and 3, the tray device of the microwave oven according to a first embodiment of the present invention includes a tray 50, which linearly travels in the cooking chamber 10, a motor 60 for supplying driving force to the tray 50, a support 70 disposed between a bottom plate 12 and the tray 50 to support the tray 50, and a power transmission for transmitting the driving force of the motor 60 to the tray 100 such that the support linearly moves.

The tray 50 has an approximately rectangular shape and is generally made of high temperature glass.

The support 70 is made of plastic. The support 70 receives the driving force of the motor 60 through the power transmission and travels right and left and moves the tray 50 placed thereon right and left. The support 70 has a guide hole 71 for guiding the linear movement of the support 70 in association with the power transmission. The guide hole 71 may have various shapes having a front-rear directional side longer than a right-left directional side.

The guide hole 71 may have an oval shape having a major axis in the same direction as the front-rear direction of the cooking chamber 10. The power transmission rotates and moves within the guide hole 71, and contacts the inner surface 71*a* of the guide hole 71 at a predetermined region to push the support 70, thereby causing the support 70 to linearly travel.

Particularly, when the support 70 reaches the rightmost or leftmost side within the traveling region, the power transmission is separated from the inner surface 71*a* of the guide hole 71 and moves freely. The oval shape of the guide hole 71 may be designed to allow the free movement region to be 90 degrees. As a result, time when the tray 50 stops at the leftmost side of the cooking chamber 10, time when the tray 50 travels from the left side to the right side, time when the tray 50 stops at the rightmost side, and time when the tray 50 travels from the right side to the left side are equal so that food can be uniformly cooked. When designing the guide hole 71, the region, where the power transmission travels freely without contacting the inner surface 71*a* of the guide hole 71, can be adjusted by changing the major axis and minor axis of the guide hole 71. In other words, if the guide hole 71 has a highly elliptical oval shape, the free movement region may be shorter, and if the guide hole 71 has a slightly elliptical oval shape, the free movement region may be longer.

As shown in FIGS. 2 and 3, the power transmission may include a linkage 81 having a side coupled with a rotation shaft 61 of the motor 60 and the other side contacting the inner surface 71*a* of the guide hole 71. The linkage 81 may include a roller 82 provided at the end thereof contacting the inner surface 71*a* of the guide hole 71 such that driving power is smoothly transmitted. Although the linkage 81 having the roller 82 is depicted in FIGS. 2 and 3, since the roller 82 is an optional member, the linkage 81 can directly contact the inner surface 71*a* of the guide hole 71 without the roller 82.

Figure 4:
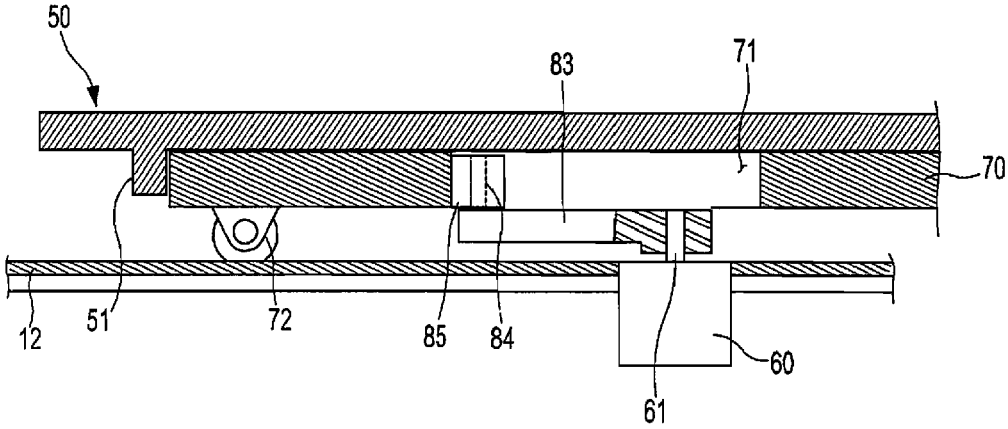
FIG. 4 is an exploded perspective view illustrating the structure of a tray device of a microwave oven according to a second embodiment of the present invention.

FIG. 4 is an exploded perspective view illustrating the structure of a tray device of a microwave oven according to a second embodiment of the present invention. As shown in FIG. 4, the power transmission may include a linkage 83 having an end coupled with the rotation shaft 61 of the motor 60 and a protrusion 84 protruded upward from the linkage 83. The protrusion 84 rotates and moves in the guide hole 71 and contacts the inner surface 71*a* of the guide hole 71, thereby causing the support 70 to linearly move right and left.

The protrusion 84 may include a roller 85 having the protrusion 84 as a rotation shaft such that driving force is smoothly transmitted when the protrusion 84 contacts the inner surface 71*a* of the guide hole 71. Although FIG. 4 depicts the protrusion 84 including the roller 85, since the roller 85 is an optional member, the protrusion 84 can directly contact the inner surface 71*a* of the guide hole 71 without the roller 85.

Moreover, the tray device of the present invention includes a tray restriction device or a tray moving device for guiding the movement of the tray 50 from the movement of the support 70 and linearly moving the tray 50 together with the support 70. The tray restriction device prevents the tray 50 from separating from the support 70 such that the tray 50 moves together with the support 70, and the tray moving device transmits the movement of the support 70 to the tray 50 and moves the tray 50 when the support 70 moves.

The tray restriction device will be described first. As shown in FIGS. 2 to 4, the tray restriction device may include a locking step 51 protruded from the lower surface of the tray 50. Since the support 70 and tray 50 move right to left and left to right, although two locking steps 51 satisfies the condition that the locking steps 51 are caught by the right and left sides of the support 70, the locking step 51 may be formed to surround the outer circumference of the support 70.

Meanwhile, in a surface of the support 70 adjacent to the bottom plate 12, a plurality of guide rollers 72 is formed to allow smooth movement of the support 70 on the bottom plate 12. The bottom plate 12 includes guide grooves 12*a* for guiding the guide rollers 72.

Figure 5:
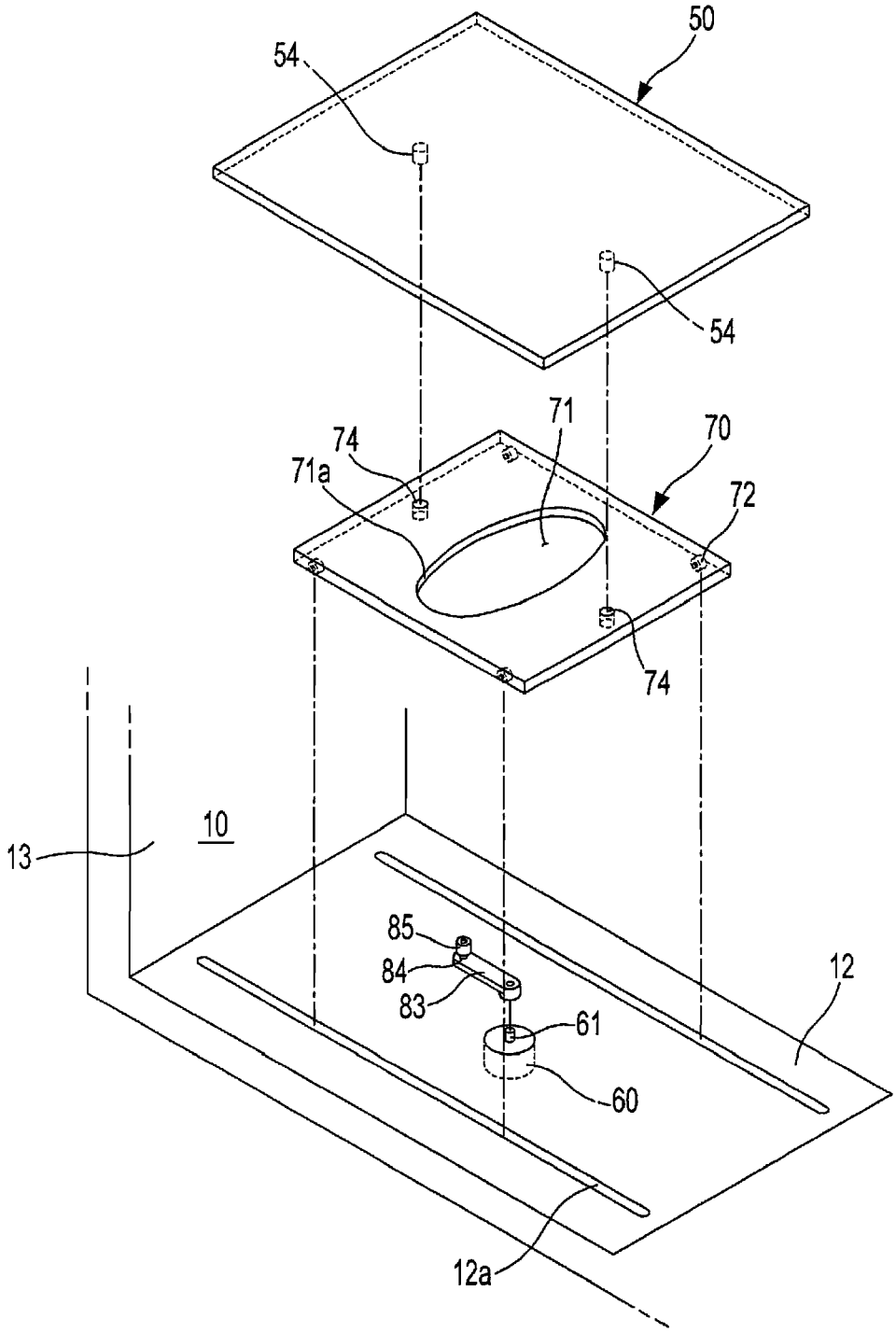
FIG. 5 is an exploded perspective view illustrating the structure of a tray device of a microwave oven according to a third embodiment of the present invention.

FIG. 5 is an exploded perspective view illustrating the structure of a tray device of a microwave oven according to a third embodiment of the present invention. The tray device of the third embodiment of the present invention is a modification of the tray device of the second embodiment in which the tray restriction device is modified. As shown in FIG. 5, the tray restriction device may have a groove and a protrusion. In other words, the tray restriction device is structured such that an engaging protrusion (or an engaging groove) is formed in the lower surface of the tray 50 and an engaging groove (or an engaging protrusion) is formed in the upper surface of the support 70 and engaged with the engaging protrusion (or the engaging groove) thereby linearly moving the tray 50 together with the support 70. FIG. 5 depicts the tray restriction device in which the engaging protrusion 54 and the engaging groove 74 are respectively formed in the lower surface of the tray 50 and the upper surface of the support 70.

Figure 6:
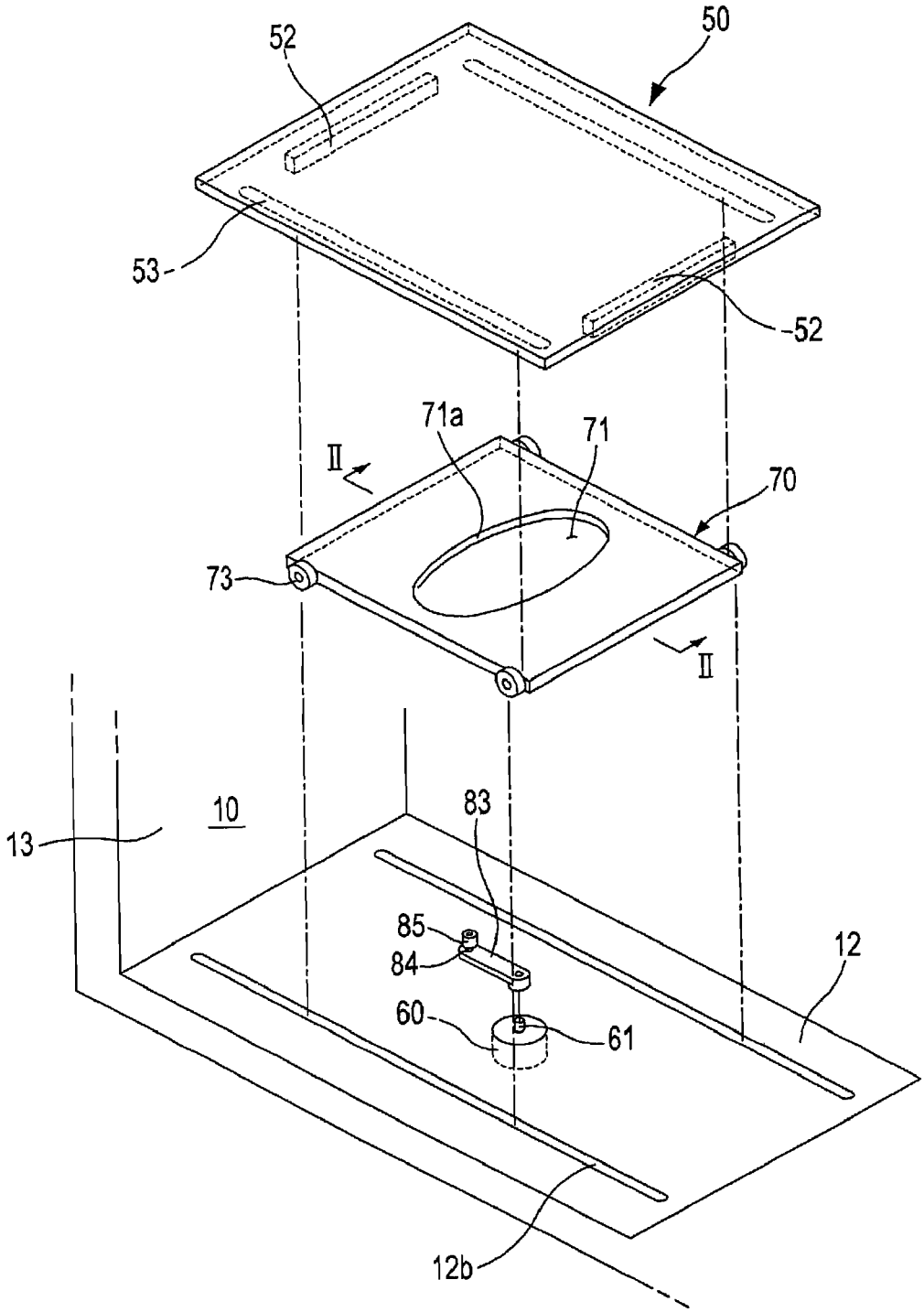
FIG. 6 is an exploded perspective view illustrating the structure of a tray device of a microwave oven according to a fourth embodiment of the present invention.
Figure 7:
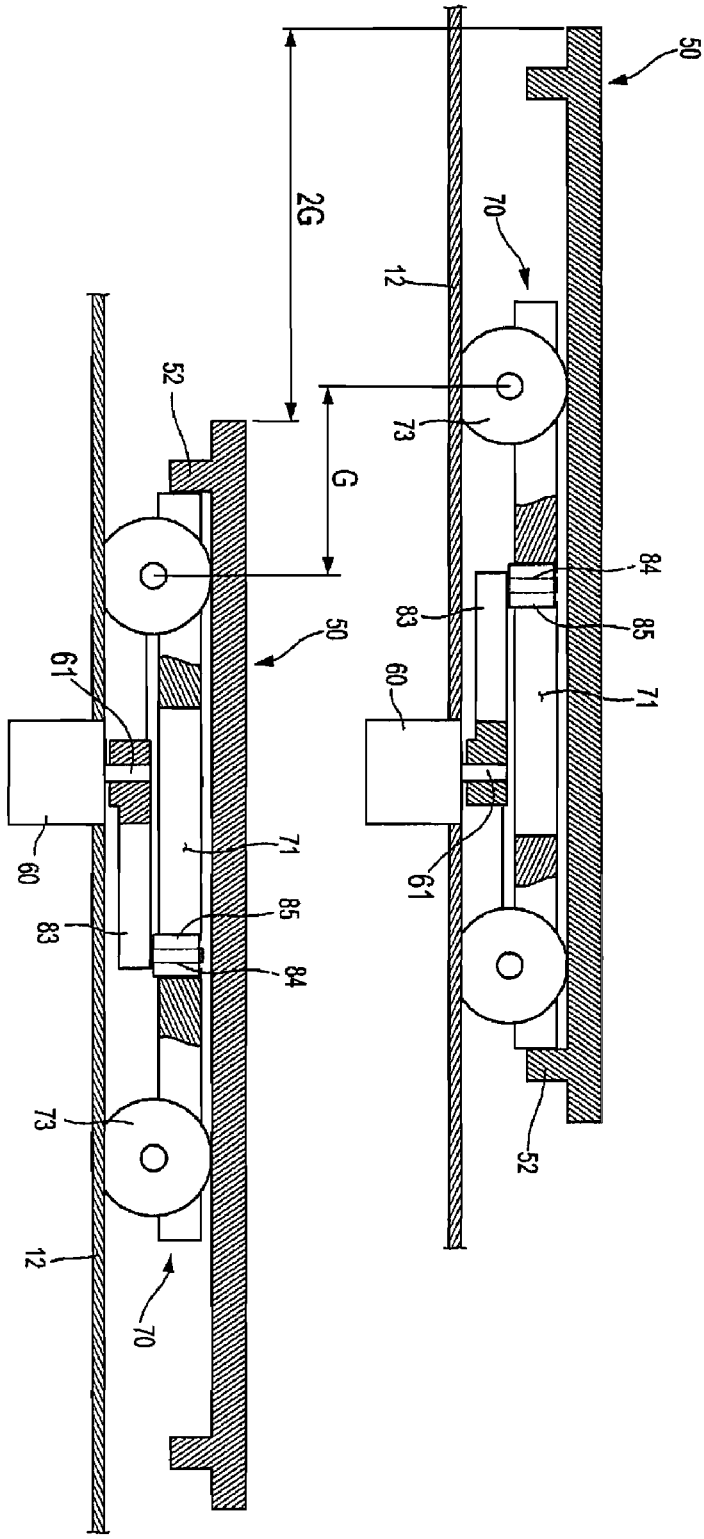
FIG. 7 is a sectional view taken along line II-II in FIG. 6 when the tray device in FIG. 6 is assembled, and illustrating the traveling distances of a supporter and a tray of the tray device in FIG. 6.

Next, the tray moving device will be described. FIG. 6 is an exploded perspective view illustrating the structure of a tray device of a microwave oven according to a fourth embodiment of the present invention, and FIG. 7 is a sectional view taken along line II-II in FIG. 6 when the tray device in FIG. 6 is assembled, and illustrating the traveling distances of a supporter and a tray of the tray device in FIG. 6. As a matter of convenience, FIGS. 6 and 7 depict a tray device including the power transmission of the second embodiment.

As shown in FIGS. 6 and 7, the tray moving device may include movable rollers 73 contacting the bottom plate 12 disposed below the movable rollers 73 and contacting the lower surface of the tray 50 disposed above the movable rollers 73. The movable rollers 73 contact the bottom plate 12 to smoothly move the support 70 on the bottom plate 12 and contact the lower surface of the tray 50 to move the tray 50 right and left together with the support 70.

As such, when the tray 50 is moved together with the movable rollers 73, the tray 50 travels twice the distance traveled by the support 70. In other words, as shown in FIG. 7, assuming the distance where the support 70 travels due to the movable rollers 73 is "G", the tray 50 travels the distance "G" together with the support 70 and further travels the distance "G" due to the movable rollers 73 rolling on and contacting the tray 50. Thus, although the tray 50 travels equal distance, the size of the linkage 83 can be cut in half in comparison with the case that the power transmission directly moves the tray 50. Although FIG. 7 illustrates that the support 70 moves from the leftmost side to the rightmost side, the principle illustrated in FIG. 7 can be applied to all the cases that the support 70 travels a predetermined distance.

In the lower right and left ends of the tray 50, locking steps 52 may be formed to prevent the tray 50 from moving further to the right side or the left side, thereby preventing the tray 50 from colliding with the side plates 13.

In the lower surface of the tray 50 and the bottom plate 12, guide grooves or guide rails may be formed. The movable rollers 73 are partially inserted into the guide grooves (or guide rails) so that the tray 50 and the support 70 stably and linearly travel. FIGS. 6 and 7 depict the tray device in which the guide grooves 53 and 12*b* are respectively formed in the tray 50 and the bottom plate 12.

FIGS. 8A-8F are views illustrating operation of the tray device of the microwave oven according to the second embodiment of the present invention. As a matter of convenience, although the tray device according to the second embodiment of the present invention will be described, the principle described with respect to the tray device of the second embodiment can be applied to the tray device according to the first embodiment, a third embodiment, and a fourth embodiment. In the tray device according to the fourth embodiment of the present invention, as described above, the tray device 50 travels twice the distance traveled by the support 70.

Figure 8A:
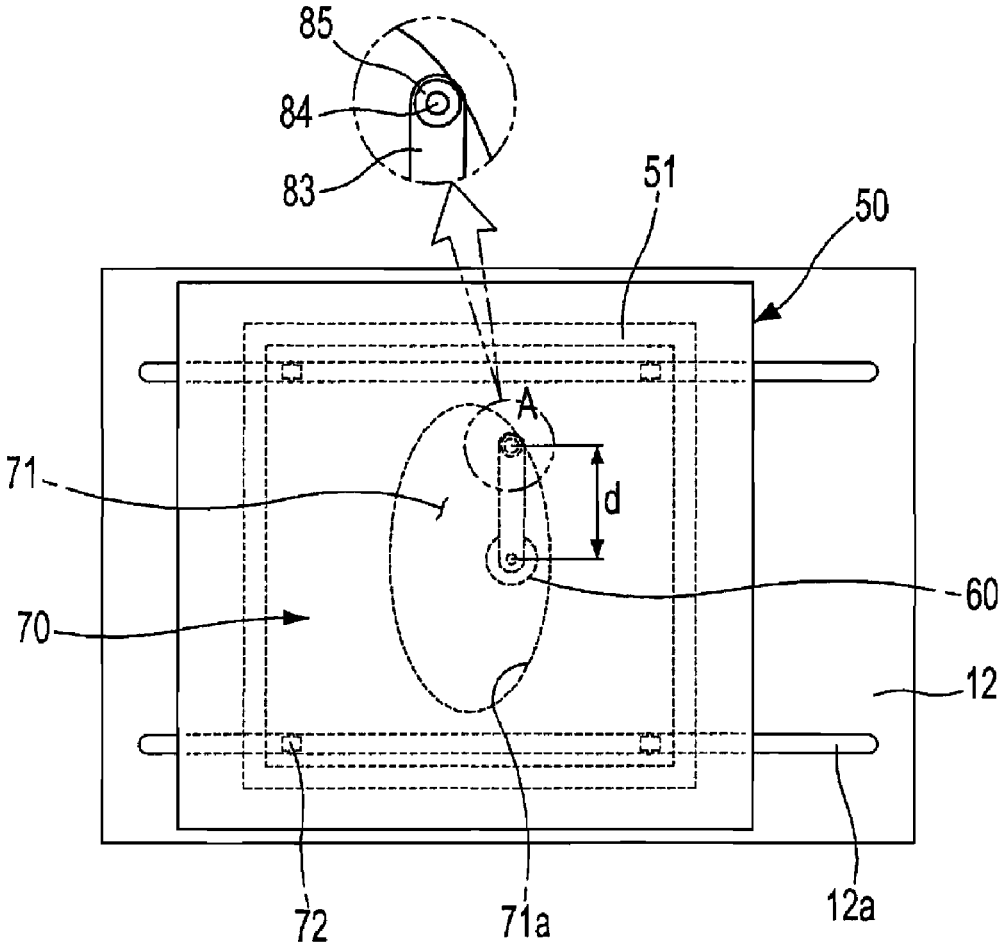
FIGS. 8A-8F are views illustrating operation of the tray device of the microwave oven according to the second embodiment of the present invention.
Figure 8B:
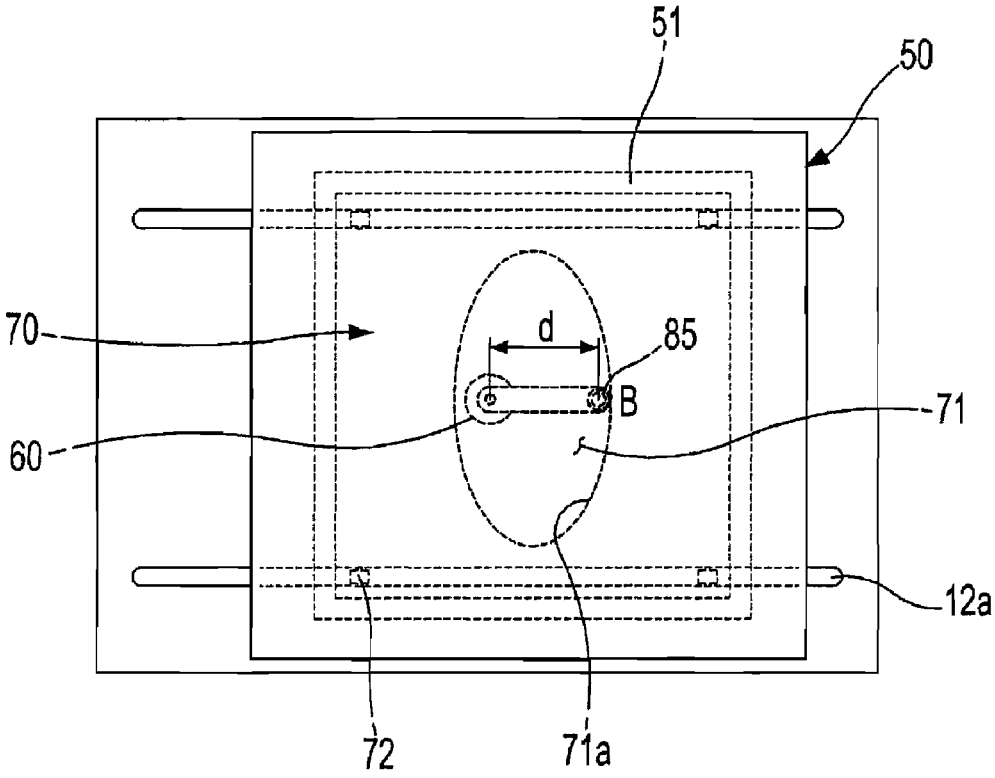
Figure 8C:
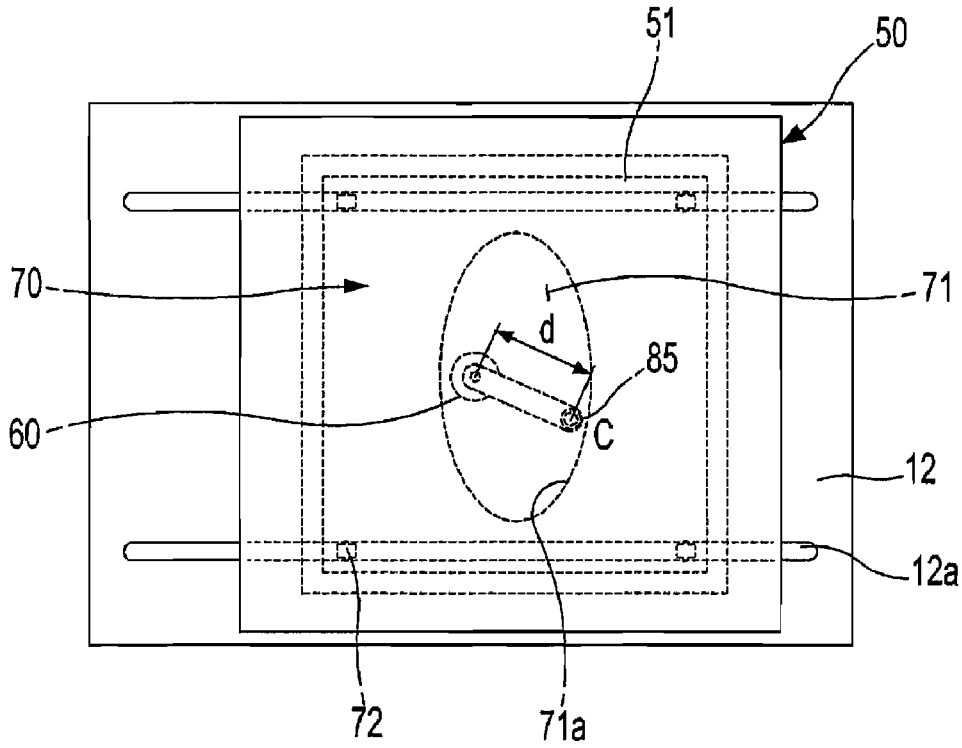
Figure 8D:
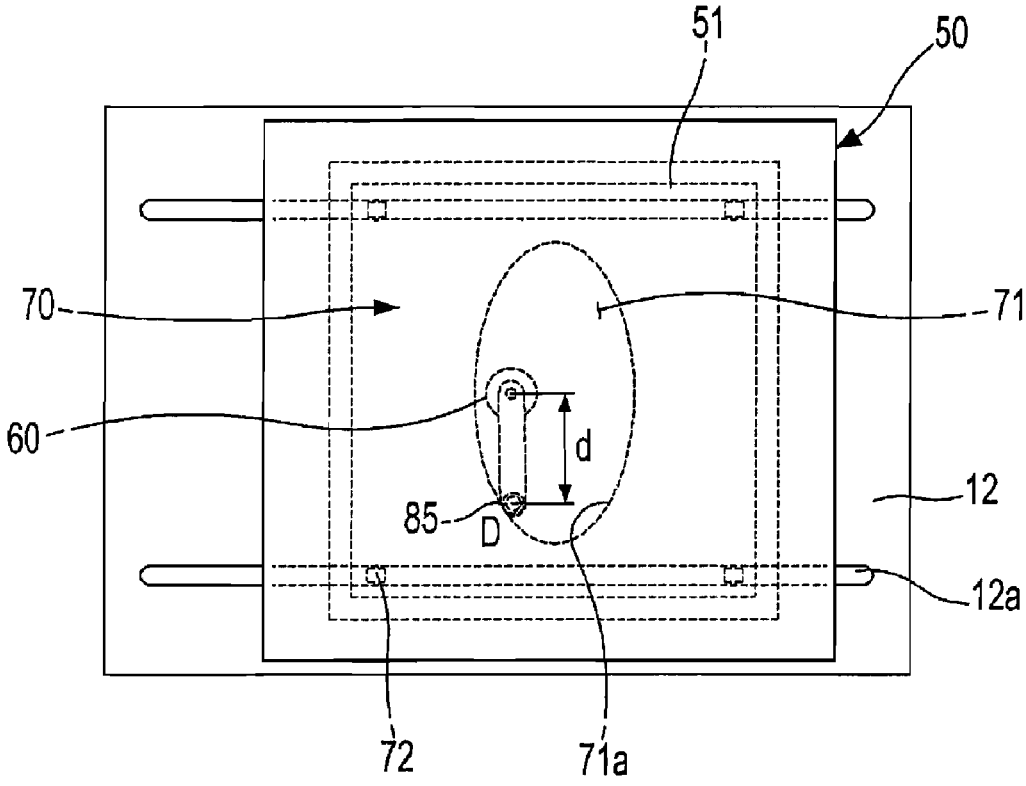
Figure 8E:
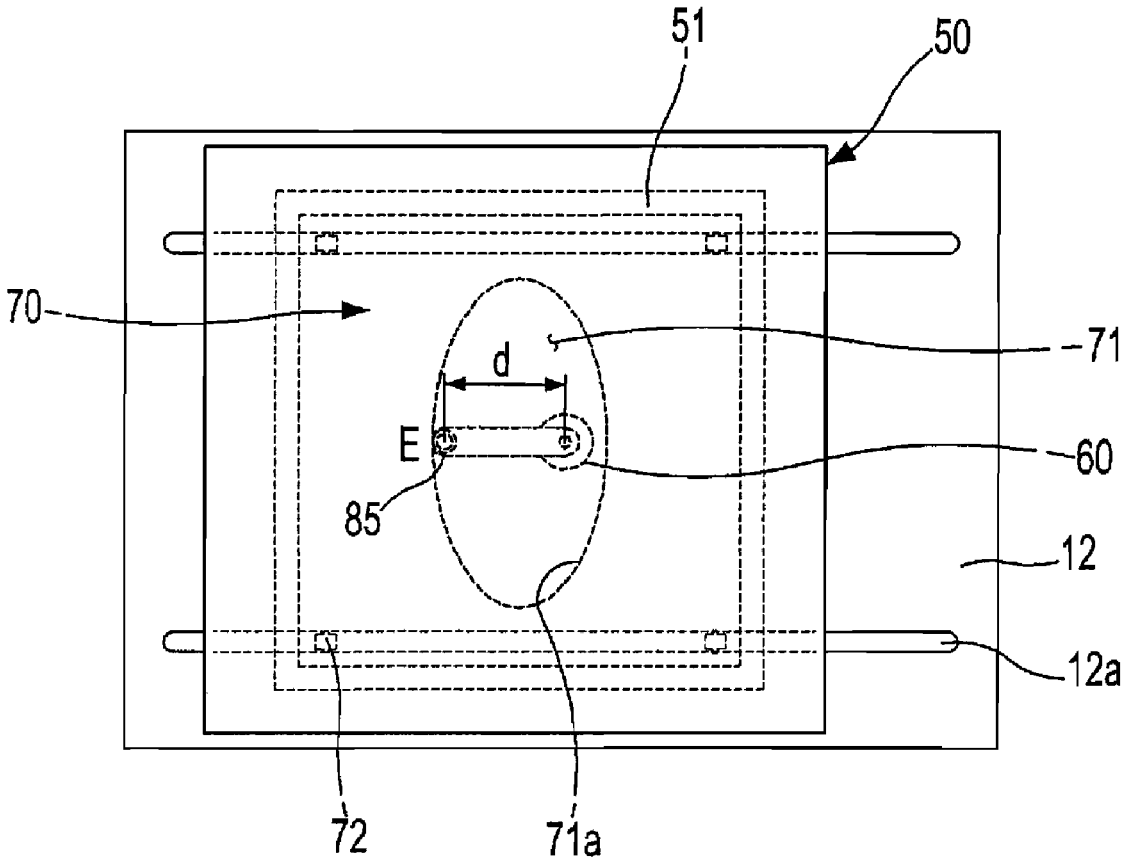
Figure 8F:
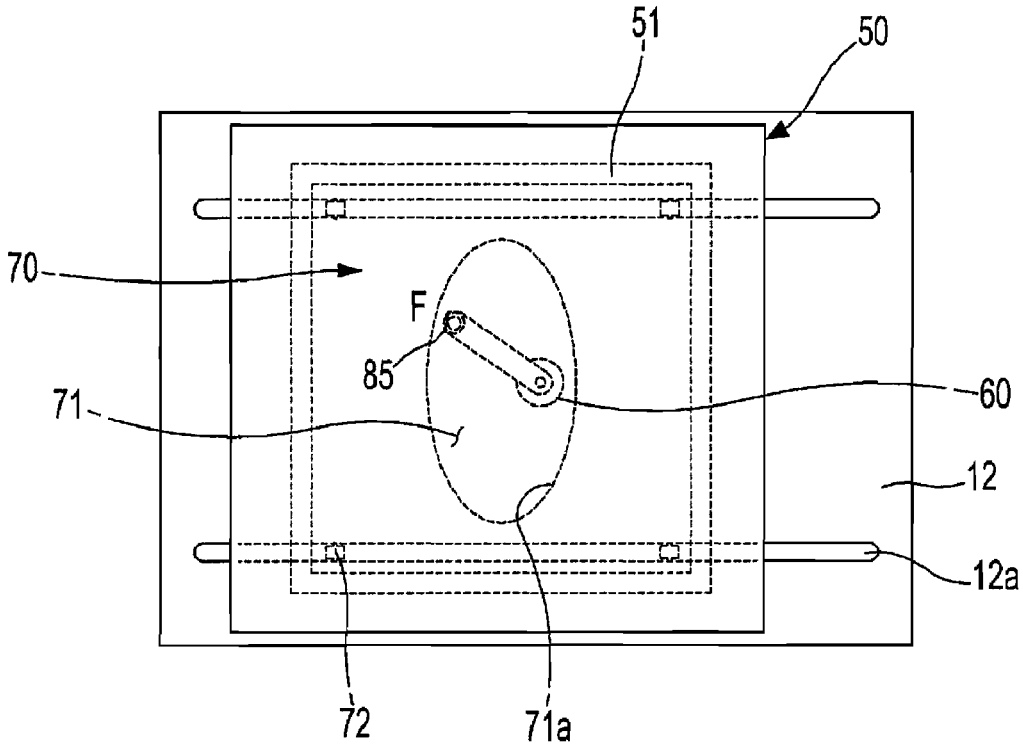

In detail, FIG. 8A is a view illustrating when the tray 50, positioned at the leftmost side in the traveling region, is starting to move to the right side, FIG. 8B is a view illustrating when the tray 50 reaches the rightmost side, and FIG. 8C is a view illustrating the roller 85 detached from the inner surface 71*a* of the guide hole 71 such that the support 70 and the tray 50 do not move and only the roller 85 rotates and travels. Moreover, FIG. 8D is a view illustrating when the roller 85 contacts the inner surface 71*a* of the guide hole 71 again such that the support 70 and the tray are starting to move to the left side, FIG. 8E is a view illustrating when the tray 50 reaches the leftmost side in the traveling region again, and FIG. 8F is a view illustrating the roller 85 is detached from the inner surface 71*a* of the guide hole 71 again such that the support 70 and the tray 50 do not move and only the roller 85 rotates and travels.

As shown in FIGS. 8A-8F, when the linkage 83 is rotated by the motor 60, the roller 85 rotates and travels within the guide hole 71 and pushes the support 70 so that the support 70 linearly reciprocates right to left and left to right. At that time, the tray 50 receives the kinetic force of the support 70 through the tray restriction device, that is, through the locking step 51 formed in the lower surface of the tray 50, and linearly travels together with the support 70 right to left and left to right.

Particularly, only in the regions (A-B region and D-E region) where the roller 85, fitted around the protrusion 84, contacts the guide hole 71, do the support 70 and the tray 50 travel right to left and left to right, and, in the regions (B-D region and E-A region) where the roller 85 does not contact the guide hole 71, the support 70 and the tray 50 stop for a predetermined period of time. Since, in the regions B-D and E-A, the tray 50 is positioned at the rightmost side or the leftmost side, the tray 50 travels again after stopping at the leftmost side or the rightmost side in the traveling region. The stopping time of the tray 50 can be adjusted by changing the shape of the guide hole 71.

As shown in FIGS. 8A-8F, the size of the traveling region of the support 70 is affected by the distance d between the protrusion 84 and the rotation shaft 61 and the size of the freely traveling region where the protrusion 84 does not contact the inner surface 71*a* of the guide hole 71 and freely travels. In the same distance d, when the freely traveling region of the protrusion 84 is long, the traveling region of the support 70 is decreased.

Figure 9:
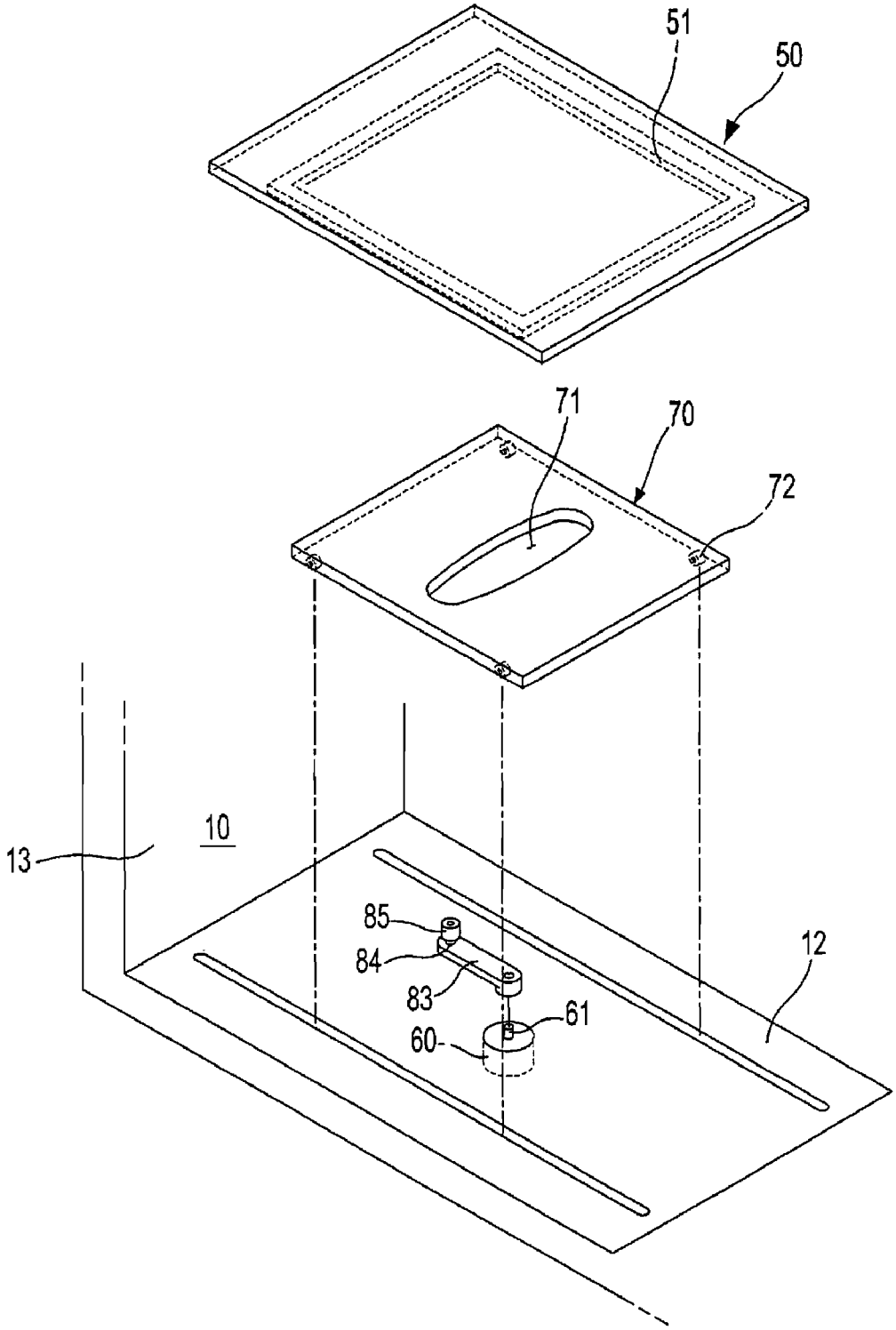
FIG. 9 is an exploded perspective view illustrating the structure of a tray device of a microwave oven according to a fifth embodiment of the present invention.
Figure 10:
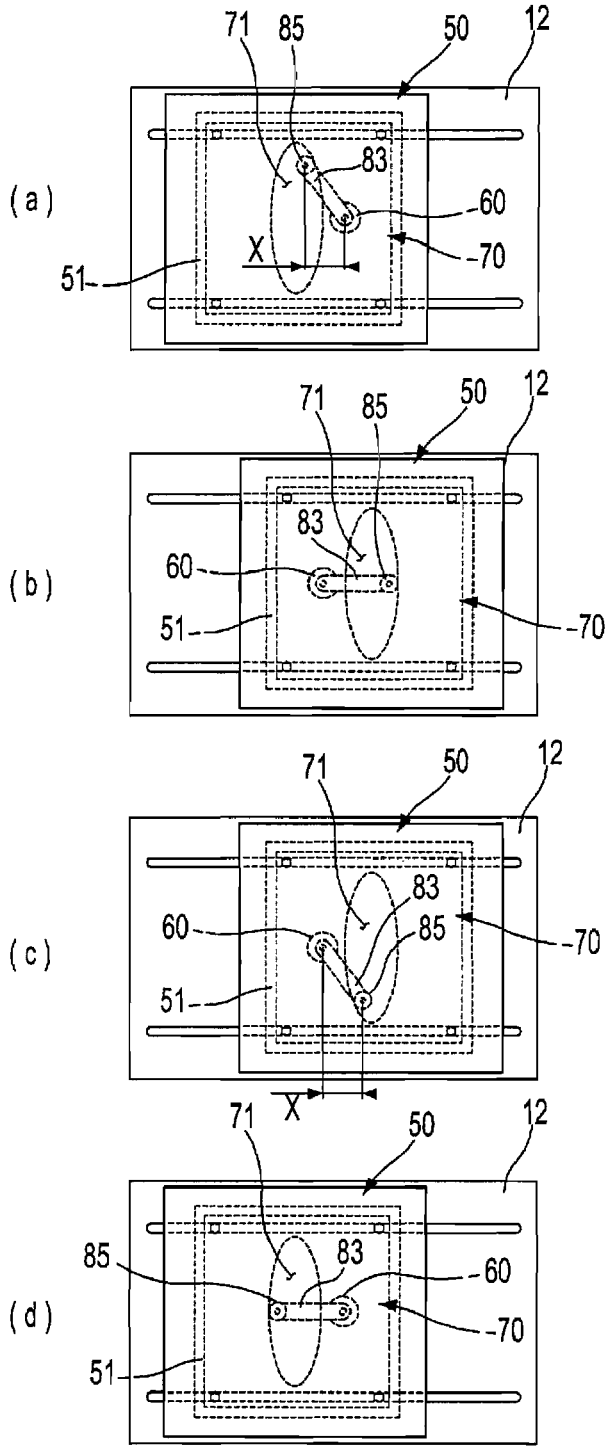
FIG. 10, parts a-d, is a view illustrating operation of the tray device in FIG. 9.

FIG. 9 is an exploded perspective view illustrating the structure of a tray device of a microwave oven according to a fifth embodiment of the present invention, and FIG. 10, parts a-d, is a view illustrating operation of the tray device in FIG. 9. The tray device of the fifth preferred embodiment is a modification of the tray device of the second preferred embodiment in which the shape of the guide hole 71 is changed into a highly elliptical oval shape such that the traveling region of the support 70 is increased. As such, when the shape of the guide hole 71 is changed, as shown in FIG. 10, since the freely traveling region of the roller 85 is decreased, the time when the support stays right and left of the cooking chamber. However, in comparison with the second preferred embodiment, the traveling distance of the support 70 is increased by 'X'. Thus, when the right-left length of the cooking chamber 10 is long and the tray 50 must frequently travel, the shape of the guide hole 71 is changed as described above so that the space of the cooking chamber 10 can be effectively utilized.

As described above, according to the tray device of the present invention, time, when the linearly traveling tray stops at the leftmost or rightmost side in the traveling region, is adjusted such that time when the tray remains at the right side and the left side in the cooking chamber is substantially not different from time when the tray travels from the right side to the left side and vise versa, so that food can be uniformly cooked at any place in the cooking chamber.

The tray device of the present invention has the structure in which the power transmission does not directly contact the tray so that the power transmission is not deformed due to the hot tray. Therefore, the power transmission can be manufactured without any restriction of material and the reliability of the microwave oven can be guaranteed.

Moreover, according the tray device of the present invention, since the tray, the support, and the power transmission are easily assembled, a user can easily install the tray device after cleaning the tray device.

Additionally, when the movable rollers are used as the tray moving device in the present invention, since the tray travels twice the distance traveled by the support, the size of the linkage for moving the tray at a predetermined distance can be cut in half and costs for parts can be reduced.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A microwave oven comprising:

a cooking chamber having a bottom plate;

a tray linearly traveling in the cooking chamber;

a motor providing driving force necessary for the movement of the tray;

a support disposed between the bottom plate and the tray to support the tray;

at least one guide structure formed at the bottom plate to guide a movement of the support;

an oval guide hole formed through the support, the guide hole having a first radius in a major axis direction and a second radius in a minor axis direction; and a linkage to receive the driving force from the motor so that the linkage rotates within the guide hole, wherein the linkage has a rotation radius larger than the second radius of the guide hole, to linearly move the support while being in contact with an inner surface of the guide hole, and the first radius of the guide hole is larger than the rotation radius of the linkage, to allow the linkage to rotate freely in a state of being spaced apart from the inner surface of the guide hole, and the support linearly travels between a first position and a second position along right and left directions and the linkage is separated from the inner surface of the guide hole when the support reaches the first position or the second position, to allow the support to stop at the first position or the second position for a predetermined time.

2. The microwave oven according to claim 1, wherein the linkage contacts the guide hole to move the support to a rightmost side or to a leftmost side while rotating by 90 degrees, and freely moves while rotating by 90 degrees again.

3. The microwave oven according to claim 1, further comprising a movable roller installed in the support to contact the bottom plate disposed below the movable roller and to contact the lower surface of the tray disposed above the movable roller.

4. The microwave oven according to claim 3, wherein the tray further includes a guide groove or a guide rail formed in the lower surface of the tray to guide the movable roller.

5. The microwave oven according to claim 3, wherein the guide structure includes a guide groove or a guide rail to guide the movable roller.

6. The microwave oven according to claim 1, further comprising locking steps protruded from a right end and a left end of the lower surface of the tray to restrict the linear movement of the tray.

* * * * *